United States Patent [19]

Yueh

[11] 4,279,381

[45] Jul. 21, 1981

[54] METHOD FOR UNIFORMLY HEATING A MULTI-LEVEL BUILDING

[76] Inventor: Yang Yueh, 209-03 White Hall Ter., Queens Village, N.Y. 11427

[21] Appl. No.: 80,129

[22] Filed: Sep. 28, 1979

[51] Int. Cl.[3] ..... F24D 3/00

[52] U.S. Cl. ..... 237/81; 237/56; 236/9 R; 236/9 A; 165/22

[58] Field of Search ..... 237/8 R, 56, 81; 236/9 A, 9 R, 1 R; 165/22

[56] References Cited

U.S. PATENT DOCUMENTS

| | | | |
|---|---|---|---|
| 2,849,185 | 8/1958 | Keyes | 237/8 R |
| 3,086,710 | 4/1963 | Shimko | 236/9 |

FOREIGN PATENT DOCUMENTS

| | | | |
|---|---|---|---|
| 311607 | 3/1919 | Fed. Rep. of Germany | 237/56 |

*Primary Examiner*—Larry I. Schwartz

*Assistant Examiner*—Henry Bennett

[57] ABSTRACT

A method is disclosed for uniformly regulating and controlling the temperature in a multi-level building utilizing a common heat source. Only a single thermostat is required. The thermostat is placed in the room as near the end of the longest conduit and is set at the desired temperature. At least one and possibly a plurality of heating units such as radiators, each having its own output control valve, is placed on each level of the building. After the thermostat has been set at the desired temperature, each valve that controls the various heating unit is individually set. The radiator valve in the room in which the thermostat is located is opened all the way. The remaining valves are opened by a progressively smaller amount in those rooms further away from the thermostat. Once all of the rooms reach the desired temperature the valves are permanently set in order to prevent their unauthorized adjustment.

1 Claim, 1 Drawing Figure

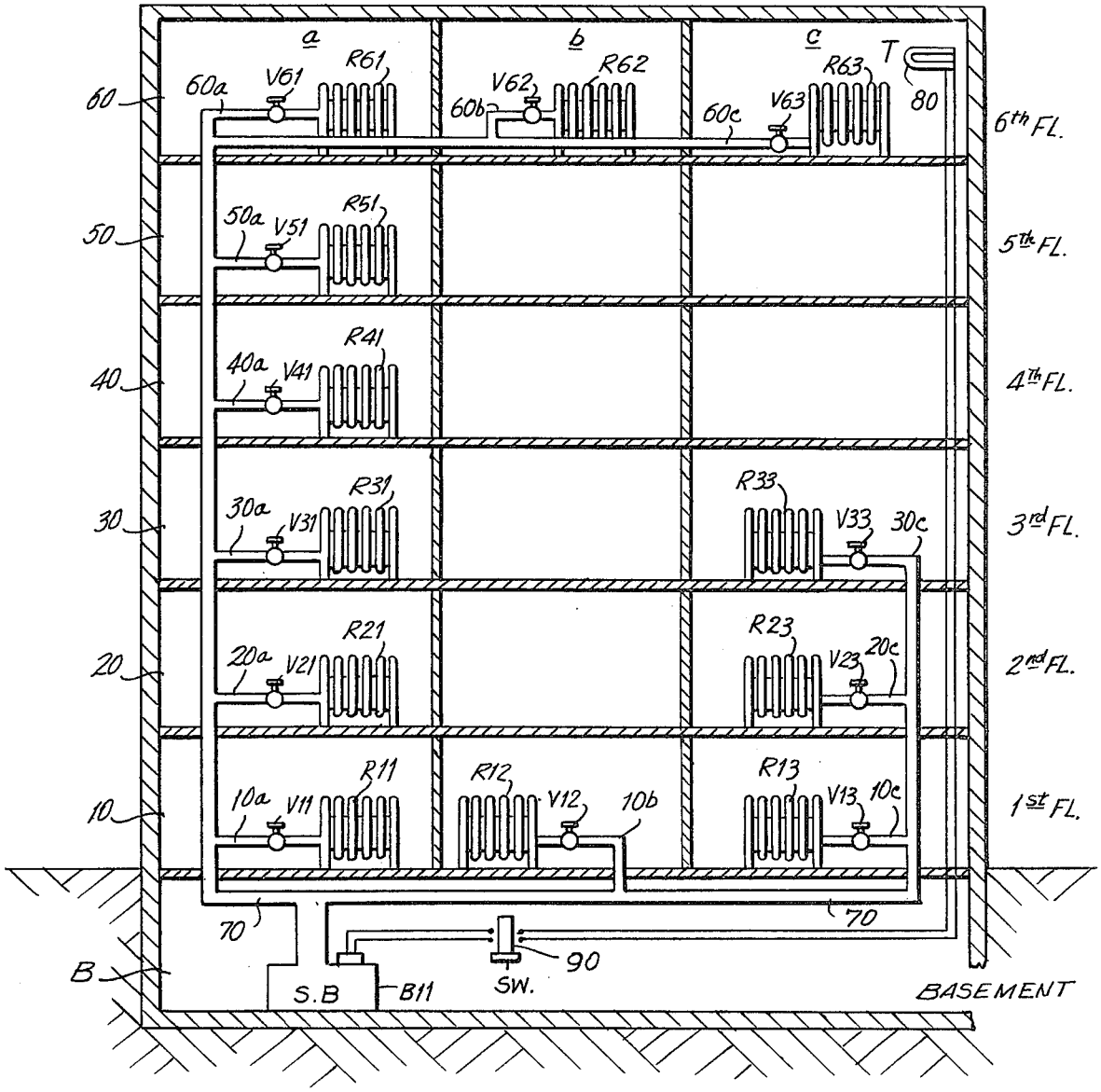
a
b
c
T
60
60a
V61
R61
V62
R62
60b
60c
V63
R63
80
6th FL.
50
50a
V51
R51
5th FL.
40
40a
V41
R41
4th FL.
30
30a
V31
R31
R33
V33
30c
3rd FL.
20
20a
V21
R21
R23
V23
20c
2nd FL.
10
10a
V11
R11
R12
V12
10b
R13
V13
10c
1st FL.
70
70
90
B
S.B
B11
SW.
BASEMENT

METHOD FOR UNIFORMLY HEATING A MULTI-LEVEL BUILDING

BACKGROUND OF THE INVENTION

1. Field of the Invention

This invention relates generally to a method for controlling the use of heating energy and more particularly to a method for providing uniform heating in a multi-level building, usually less than twenty stories.

2. Description of the Prior Art

One method for regulating and controlling the temperature on various floors of a multi-level building is by the provision of a thermostat for each floor. While this is a very widely accepted practice and is efficient, it does have very serious drawbacks. For example, energy could be wasted very easily since there is no central control for each of the thermostats. In a multi-level building, for example where there are a plurality of apartments, it would be entirely possible for the temperature to be maintained at either excessively high levels or at excessively low levels, and thereby result in increased costs to the landlord or owner of the building, as well as a waste of energy.

In another form of prior art, only a single thermostat is utilized. It has been the accepted practice to place the single thermostat at as low a level as possible. Since hot air rises, it was expected that the heat from the lower floors would find its way upwardly and accordingly, when the lower floor wherein the thermostat was positioned, reached the desired temperature, the upper floors would surely be heated to at least this desired temperature. It will be evident, however, that the upper floors could conceivably become overheated before the lower floor reaches the desired temperature.

While the theory of hot air rising is undoubtedly correct, and it may very well occur in a single large room such as a warehouse in a multi-level building having partitions, separations, individual rooms and individual apartments, the physical separation of each of these enclosures prevents sufficient flow of heat and accurate monitoring of temperature from the lower floors to the higher floors. As a result, when the thermostat is placed in the lowest position, a condition frequently occurs that is contrary to the desired result.

The heat flow through the pipes and tubes is more critical in determining uniformity than the air flow within the given enclosure. Whether pipes are used for hot water or steam heating, or ducts are used for hot air heating, the heat will reach the lower floor and cause the temperature on the lower floor to reach a higher value before the upper floors. The heated air in each enclosure does not flow upwardly as quickly as is necessary and in order to achieve a higher temperature on the higher floors, it is necessary to set the thermostat on the lower floor at an unnecessarily high level. This results in uneven heating whereby the lower floors will be relatively warm and the upper floors will be relatively cold.

The basic problem has been recognized for quite some time but prior to my invention there has been no practical resolution of the problem. One example of a prior art attempt to solve the problem is disclosed in U.S. Pat. No. 2,195,802 granted on Apr. 2, 1940 to H. S. Turner. In this patent there is disclosed a plurality of thermostats for each feedline with the resulting effect of each thermostat being interrelated with the others. Although this patent does disclose a thermostat at the end of one line, this is used only for minimum temperature control and not for the main temperature control. Furthermore, the effect of the thermostat at the end of the line is always interrelated and integrated with the effects of the other thermostats utilized in the same patented structure. There is no disclosed control of the quantity of heat emitted by each of the radiators. What is provided is an automatic control to reset the thermostats in accordance with the interrelationships that are developed. It will be very evident that the structure disclosed in this patent is extremely costly to purchase and install and requires excessively expensive maintenance.

U.S. Pat. No. 2,868,461 granted on Jan. 13, 1939 to G. T. Gaddis is another example of the prior art directed to the same problem as the present invention. This patent discloses plural zones each having its own valve. However, this patent discloses, basically, a feedback system for controlling the flow in the entire zone in accordance with the information developed from the thermostat. Although the patent does show the use of a thermostat at the end of a feedline, there is no control from that thermostat for the entire feedline in order to provide a uniform temperature. Instead, the patented structure makes use of the inside as well as the outside thermostats to control the single valve for the entire zone. There is no disclosure in this patent for controlling each individual radiator valve.

In U.S. Pat. No. 2,376,482, granted on May 22, 1945 to G. D. Guler et al. there is a disclosure for a control for a main valve that is responsive to changes in outside temperature. It will be appreciated from the description of the present invention that follows that the Guler et al. patent is distinguished therefrom by its absence of any inverse relationship between the temperature gradient and the quantity of heat flow.

U.S. Pat. No. 2,140,486 granted on Dec. 13, 1938 to J. Turner is another example of the prior art in the same general field to which the present invention is directed. This last mentioned patent provides control of individual regulators in order to maintain a specified temperature. However, this last mentioned patent basically discloses a feedback system wherein the control is continuous in accordance with the settings of the thermostat. The patented structure does not provide any disclosure relating to an inverse relationship between the location of a plurality of valves and a single, common heat source.

By way of summary then, although the foregoing examples of the prior art teach feedback system, the use of a valve control for each radiator, interrelationships between thermostats and many other features, none of them disclose or suggest a particular pattern for the control or the distribution of the quantity of heat at each particular location in order to achieve uniform heating along a common feedline by means of a single thermostat located at a point most remote from the heat source. The present invention permits a constant temperature to be reached on every floor with simple and efficient means. The temperature is stable and can be controlled automatically.

SUMMARY OF THE INVENTION

In its broadest aspect, the present invention provides a method for regulating and controlling the temperature in a multi-building utilizing a plurality of radiators of the like that are fed from a single heating source and wherein only a single thermostat is required at the end of the longest of the conduit. The method of the present invention contemplates first setting the thermostat at the desired temperature. Then, each valve that controls the heating unit such as radiators closest to the thermostat is opened all the way. The remaining valves are set such that their openings are progressively smaller the further they are away from the thermostat. When all of the rooms have reached the desired temperature the valves may be permanently set to prevent their unauthorized use. In addition, it is within the scope of the present invention to provide an emergency switch.

Accordingly, it is an object of the present invention to provide an improved method for uniformly regulating and controlling the temperature in a multi-level building.

It is another object of the present invention to provide a method as described above, wherein only a single thermostat is utilized.

Still another object of the present invention is to provide a method, as described above, wherein a single thermostat is positioned at or near the end of the longest conduit.

Still another object of the present invention is to provide an improved method, as described above wherein the valves of each heating unit are adjusted individually such that the opening of each valve is progressively smaller in rooms further away from the thermostat.

A further object of the present invention is to provide means for preventing the unauthorized manipulation of the valves associated with each heating unit.

These and other objects, features, and advantages of the invention will, in part, be pointed out with particularity, and will, in part, become obvious from the following more detailed description of the invention, taken in conjunction with the accompanying drawing, which forms an integral part thereof.

DESCRIPTION OF THE PREFERRED EMBODIMENT

In many older multi-level buildings, the thermal control is installed at the ground floor for operational conveniences. However, this installation resulted in many disadvantages. For example, the room temperatures on the lower floors were always higher than those on the upper levels. The resulting temperature gradient caused an energy waste and discomfort for either the upper or the lower floor residents and frequently for both. In addition, the upper floor temperature was subject to fluctuation due to variations in the control system on the lower floors. The manual operations required by the older systems very frequently suffered from human error and resulted in difficulties in maintaining a stable temperature.

One common practice for overcoming the foregoing difficulties was to raise the thermostat setting above the required temperature on the lower floor. However, the heat generated during the operation of the burner ws still not efficiently transported to the upper floors thereby making it virtually impossible to arrive at and maintain a comfortable room temperature on all of the floors.

The purpose of the present invention is to improve the existing heating system for multi-level buildings such as an apartment house, an office building, and private residences, so that a stable temperture for every room on every floor can automatically be maintained with a high degree of precision. The present invention provides a new and economical method which can correct the foregoing disadvantages and result in a large reduction in fuel costs while still maintaining a comfortable living condition.

The first step in adopting the method comprising the present invention is to move the original thermostat from the ground floor to the top floor of the building and to place it at or as near the end of the longest conduit as possible. Any additional wiring that is required should of course be the same as the original insulated conductors. The method comprising the present invention includes the following steps:

1. In the room on the floor where the thermostat is installed, the radiator valve should be opened all the way so that this room will reach the desired temperature within the shortest time in order to cut the fuel burning time.

2. The radiator valve in other rooms at the same or lower floors should be adjusted in such a manner that the valve openings in the rooms farther away from the thermostat and on the lower floors become progressively smaller. While the adjustment format is complicated and does depend upon the size, shape and position of the rooms, the correct openings can be determined within a very short time span. The degree to which the valves are opened during the first setting period can be aided by the use of a thermostat in each room. Subsequent minor adjustments based on experience within a specific building will take very little time.

3. After all the rooms have arrived at the desired stable temperatures, all of the radiator valves are tightly fixed in order to avoid unnecessary readjustment due to outside temperature variations. This may be done by any suitable means such as the use of sealing wax, for example. It should be noted at this time that readjustment should never be needed once the system has been properly adjusted. Further changes, if necessary, of the uniform temperature of the entire building can be made by adjusting the thermostat on the top level.

Referring now to the single FIGURE in the drawing, there is shown a multi-level building having a basement B and a plurality of levels designated by the reference characters 10, 20, 30, 40, 50 and 60. A heating source B 11 in the form of a steam boiler is located in the basement B which is the lowest of the levels and, for purposes of explanation, each level is divided into separate rooms (a, b and c) by a wall or partition.

A conduit 70 extends from the heating source B11 to and through each of the levels in the building to each of the radiators R. Level 30 includes branches 30*a* and 30*c*, levels 40 and 50 include branches 40*a* and 50*a*, respectively and level 60 includes branches 60*a*, 60*b*and 60*c*.

In the room containing radiator R63, at the most remote point from the heating source B11, there is provided a single thermostat 80. Furthermore, on level 60 there are also provided a heating unit in each of the rooms a, b and c such as radiators R61, R62 and R63 each having a valve V61, V62 and V63, respectively, associated therewith. In a similar manner, room a on level 50 has a heating unit R51 together with a valve V51 while room a on the level 40 has a heating unit R41 and a valve V41. The remaining levels 30, 20 and 10 are similarly provided with heating units R and valves V as required.

In accordance with the present invention the thermostat 80 is set at the desired temperature. The radiator valve V63 is opened all the way so that room c on level 60 reaches the desired temperature within the shortest time span. Of the remaining valves, the valve V11 is the furthest away from the thermostat 80 and the valve V31 is at an intermediate distance with respect to the other two valves V11 and V63. Therefore, in accordance with the present invention, the opening of the valve V11 would be the smallest, the valve V31 would be opened to approximately its mid-point and the valve V63 would be opened to its maximum. During this period of valve setting, thermometers in each room can be employed in order to facilitate the proper adjustments. After all of the rooms have arrived at the desired, stable temperature all of the radiator valves are secured at their proper openings, such as by using sealing wax or other suitable means.

An emergency switch 90 can be installed in the usual manner if none has been provided in the original circuit. The emergency switch 90 is also used to stop the buring during the warm season. In addition, all bare pipes should be properly wrapped with a high quality insulating material since the common steam pipe for most buildings has a low level of insulation.

There has been disclosed hereto fore the best embodiment of the invention presently contemplated. However, it is to be understood that various changes and modifications may be made thereto without departing from the spirit of the invention.

What I claim is:

1. A method for regulating and controlling the temperature at various locations of a multi-level building that is heated from a thermostatically controlled common heating source and delivers a heating fluid to rooms being heated by means of conduits that extend from the heating source to a plurality of heating units each having an adjustable control valve associated therewith at each of the locations and by utilizing only a single thermostat, said method comprising the steps of:

(a) positioning the thermostat in the room that is at the end of the conduit most remote from the heating source;

(b) setting the thermostat at the desired set point temperature position;

(c) opening the valve associated with the heating unit most remote from the heating source to its maximum extent while retaining the remaining valves in a first position;

(d) adjusting each of the remaining valves to a second position such that the flow of a heating fluid to each heating unit is less in rooms further away from the thermostat whereby the set point temperature, is maintained substantially in all of the rooms; and (e) fixing the valves in their second positions.

* * * * *